US010280913B2

(12) United States Patent
Matsui

(10) Patent No.: US 10,280,913 B2
(45) Date of Patent: May 7, 2019

(54) CRYOPUMP SYSTEM, METHOD OF OPERATING THE SAME, AND COMPRESSOR UNIT

(71) Applicant: Sumitomo Heavy Industries, Ltd., Tokyo (JP)

(72) Inventor: Takaaki Matsui, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 396 days.

(21) Appl. No.: 14/206,559

(22) Filed: Mar. 12, 2014

(65) Prior Publication Data

US 2014/0260339 A1 Sep. 18, 2014

(30) Foreign Application Priority Data

Mar. 12, 2013 (JP) ..... 2013-049490

(51) Int. Cl.
*F04B 37/08* (2006.01)
*F04B 1/26* (2006.01)

(52) U.S. Cl.
CPC ..... *F04B 37/08* (2013.01); *F04B 37/085* (2013.01); *F04B 1/26* (2013.01); *F25B 2309/1428* (2013.01)

(58) Field of Classification Search
CPC .... F04B 37/08; F04B 1/26; F25B 2309/1428; F25B 2309/002; F25B 49/022; F25B 2600/2515; F25B 9/14; F25B 2345/002; Y10S 417/901
See application file for complete search history.

(56) References Cited

U.S. PATENT DOCUMENTS 5,747,703 A * 5/1998 Plisson ..... G01F 15/00 73/861.77
6,530,237 B2 * 3/2003 Morse ..... F25B 45/00 62/149
7,666,479 B2 * 2/2010 Strang ..... C23C 16/45523 118/663
2003/0123972 A1 * 7/2003 Quetel ..... F04D 25/163 415/1
2006/0101836 A1 * 5/2006 Tanaka ..... F04B 37/08 62/228.1

(Continued)

FOREIGN PATENT DOCUMENTS

JP 2005-083214 A 3/2005
JP 2009-150645 A 7/2009

*Primary Examiner* — Frantz F Jules
*Assistant Examiner* — Martha Tadesse
(74) *Attorney, Agent, or Firm* — Michael Best & Friedrich LLP

(57) ABSTRACT

A cryopump system includes a cryopump, a compressor of a working gas for the cryopump, a control device configured to control an operation frequency of the compressor, a gas line connecting the cryopump and the compressor, and a gas quantity adjustment unit configured to switch a working gas quantity of the gas line between at least a first gas quantity and a second gas quantity. When the gas line has the first gas quantity, a controllable range of the operation frequency provides a first flow rate range of the working gas. When the gas line has the second gas quantity, the controllable range provides a second flow rate range of the working gas. The second flow rate range has a non-overlapping portion with the first flow rate range.

9 Claims, 10 Drawing Sheets

(56) References Cited

U.S. PATENT DOCUMENTS

| | | | | |
|---|---|---|---|---|
| 2009/0282842 | A1* | 11/2009 | Koyama | F04B 37/08 62/56 |
| 2010/0186427 | A1* | 7/2010 | Okada | F04B 37/08 62/55.5 |

* cited by examiner

CRYOPUMP SYSTEM, METHOD OF OPERATING THE SAME, AND COMPRESSOR UNIT

BACKGROUND OF THE INVENTION

1. Field of the Invention

The present invention relates to a cryopump system and a method of operating the same, and a compressor unit suitable for use in the cryopump system.

2. Description of the Related Art

It is known to change the capacity of a helium compressor by controlling the rotational speed of a variable speed motor of the helium compressor. The compressor supplies a high pressure helium gas to an expansion type refrigerator.

A control range of the rotational speed of the motor is limited by specifications of the motor. Therefore, the capacity of the compressor can be merely changed within the limited range.

SUMMARY OF THE INVENTION

According to an aspect of the present invention, a cryopump system is provided, which includes: a cryopump; a compressor of a working gas for the cryopump; a control device configured to control an operation frequency of the compressor; a gas line connecting the cryopump and the compressor; and a gas quantity adjustment unit configured to switch a working gas quantity of the gas line between at least a first gas quantity and a second gas quantity, wherein a controllable range of the operation frequency provides a first flow rate range of the working gas when the gas line has the first gas quantity, and the controllable range of the operation frequency provides a second flow rate range of the working gas when the gas line has the second gas quantity, and wherein the second flow rate range has a non-overlapping portion with the first flow rate range.

According to an aspect of the present invention, a method of operating a cryopump system is provided, which includes: during an operation of a cryopump, controlling an operation frequency of a compressor for the cryopump; and adjusting a working gas quantity that circulates between the cryopump and the compressor from a first gas quantity to a second gas quantity during the control, wherein a controllable range of the operation frequency provides a first flow rate range when the working gas of the first gas quantity circulates, and the controllable range of the operation frequency provides a second flow rate range when the working gas of the second gas quantity circulates, and wherein the second flow rate range has a non-overlapping portion with the first flow rate range.

According to an aspect of the present invention, a compressor unit of a working gas for a cryogenic device is provided, which includes: a compressor; a compressor controller configured to control an operation frequency of the compressor; and a gas quantity adjustment unit configured to switch a working gas quantity that circulates between the compressor and the cryogenic device between at least a first gas quantity and a second gas quantity, wherein a controllable range of the operation frequency provides a first flow rate range of the working gas when the working gas of the first gas quantity circulates, and the controllable range of the operation frequency provides a second flow rate range of the working gas when the working gas of the second gas quantity circulates, and wherein the second flow rate range has a non-overlapping portion with the first flow rate range.

Optional combinations of the aforementioned constituting elements, and implementations of the invention in the form of methods, apparatuses, and systems, may also be practiced as additional modes of the present invention.

BRIEF DESCRIPTION OF THE DRAWINGS

Embodiments will now be described, by way of example only, with reference to the accompanying drawings that are meant to be exemplary, not limiting, and wherein like elements are numbered alike in several figures, in which.

DETAILED DESCRIPTION OF THE INVENTION

The invention will now be described by reference to the preferred embodiments. This does not intend to limit the scope of the present invention, but to exemplify the invention.

One of principal applications of a cryogenic refrigerator is a cryopump. In recent years, under the circumstances of an increase in the diameter of wafers, a large cryopump is sometimes used. Further, a plurality of cryopumps may be provided to a single compressor for energy saving and cost reduction. The plurality of cryopumps is typically installed to a plurality of locations in a certain large device, and is simultaneously operated. The maximum flow rate of a working gas needs to be substantially large so that the large cryopump or all of the plurality of cryopumps can be operated with a high output. Meanwhile, the minimum flow rate of the working gas is desirably substantially small so that one cryopump can be operated with a low output. As described above, the cryopump system requires a wide working gas flow rate range. A flow rate control range of the working gas required for the cryopump system may exceed a capacity control range of the compressor.

An exemplary purpose of an embodiment of the present invention is to provide a cryopump system having an expanded flow rate control range of a working gas, a method of operating the cryopump system, and a compressor unit suitable for use in the system and the method.

Figure 1:
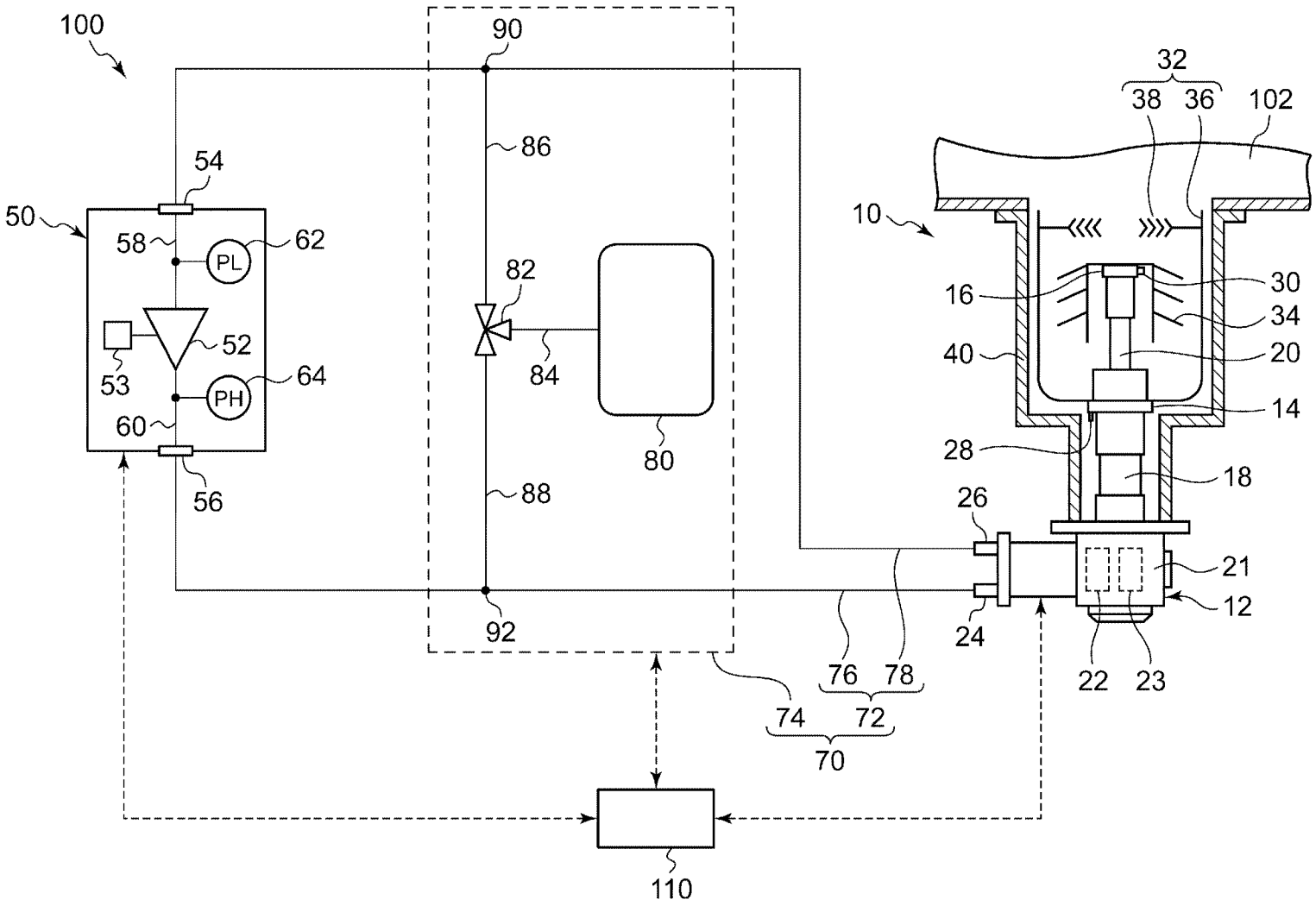
FIG. 1 is a diagram schematically illustrating an overall configuration of a cryopump system according to an embodiment of the present invention.

FIG. 1 is a diagram schematically illustrating an overall configuration of a cryopump system 100 according to an embodiment of the present invention. The cryopump system 100 is used to remove gases to generate a vacuum in a vacuum chamber 102. The vacuum chamber 102 is employed to provide a vacuum environment for a vacuum processing apparatus (for example, an apparatus used for manufacturing semiconductors, such as ion implanters and sputtering instruments).

The cryopump system 100 includes one or more cryopumps 10. The cryopump 10 is attached to the vacuum chamber 102 and used to increase the degree of vacuum in the chamber to a desired level.second-stage The cryopump 10 includes a refrigerator 12. The refrigerator 12 is a cryogenic refrigerator, such as a Gifford-McMahon type refrigerator (generally called a GM refrigerator). The refrigerator 12 is a two-stage refrigerator including a first stage 14 and a second stage 16.

The refrigerator 12 includes a first cylinder 18 and a second cylinder 20. The first cylinder 18 includes a first-stage expansion chamber defined therein, and the second cylinder 20 includes a second-stage expansion chamber defined therein. The second-stage expansion chamber is in communication with the first-stage expansion chamber. The first cylinder 18 and the second cylinder 20 are mutually connected in series. The first cylinder 18 connects a motor housing 21 and the first stage 14. The second cylinder 20 connects the first stage 14 and the second stage 16. The first cylinder 18 and the second cylinder 20 include a first displacer and a second displacer (not shown) therein, respectively. The first displacer and the second displacer are mutually connected. The first displacer and the second displacer each include a built-in regenerator therein.

The motor housing 21 of the refrigerator 12 accommodates a refrigerator motor 22 and a gas channel switching mechanism 23. The refrigerator motor 22 provides a driving force for the first and second displacers, and the gas channel switching mechanism 23. The refrigerator motor 22 is connected to the first displacer and the second displacer such that the first displacer and the second displacer can reciprocate in the first cylinder 18 and the second cylinder 20, respectively.

The gas channel switching mechanism 23 is configured to cyclically switch a channel of the working gas in order to repeat the expansion of the working gas in the first-stage and second-stage expansion chambers cyclically. The refrigerator motor 22 is connected to a movable valve (not shown) of the gas channel switching mechanism 23 such that the valve can be operated in forward and reverse directions. The movable valve is, for example, a rotary valve.

The motor housing 21 includes a high pressure gas inlet 24 and a low pressure gas outlet 26. The high pressure gas inlet 24 is formed at an end of a high pressure channel of the gas channel switching mechanism 23, and the low pressure gas outlet 26 is formed at an end of a low pressure channel of the gas channel switching mechanism 23.

The refrigerator 12 derives, from the expansion therein of a high pressure working gas (helium, for example), cooling at the first stage 14 and the second stage 16. The high pressure working gas is supplied from a compressor unit 50 through the high pressure gas inlet 24 to the refrigerator 12 when the refrigerator motor 22 switches the gas channel switching mechanism 23 such that the high pressure gas inlet 24 is connected to the expansion chambers. The expansion chambers of the refrigerator 12 are filled with the high pressure working gas. Then the refrigerator motor 22 switches the gas channel switching mechanism 23 such that the expansion chambers are connected to the low pressure gas outlet 26. The working gas is adiabatically expanded and discharged through the low pressure gas outlet 26 to the compressor unit 50. The first and second displacers reciprocate in the expansion chambers in synchronization with the operation of the gas channel switching mechanism 23. By repeating such a thermal cycle, the first stage 14 and the second stage 16 are cooled.

The second stage 16 is cooled to a temperature lower than that of the first stage 14. The second stage 16 is cooled to, for example, about 10 K to 20 K, and the first stage 14 is cooled to, for example, about 80 K to 100 K. The first stage 14 is provided with a first temperature sensor 28 for measuring the temperature of the first stage 14, and the second stage 16 is provided with a second temperature sensor 30 for measuring the temperature of the second stage 16.

The refrigerator 12 is configured to provide a so-called reverse temperature elevation by a reverse operation of the refrigerator motor 22. The refrigerator 12 is configured to cause the working gas to adiabatically compress by operating the movable valve of the gas channel switching mechanism 23 in the reverse direction to the cooling operation described above. The refrigerator 12 can heat the first stage 14 and the second stage 16 with heat of compression thus obtained.

The cryopump 10 includes a first cryopanel 32 and a second cryopanel 34. The first cryopanel 32 is fixed such that it is thermally connected to the first stage 14, and the second cryopanel 34 is fixed such that it is thermally connected to the second stage 16. The first cryopanel 32 includes a heat shield 36 and a baffle 38 and encloses the second cryopanel 34. The second cryopanel 34 includes an adsorbent on a surface thereof. The first cryopanel 32 is accommodated in a cryopump housing 40. One end of the cryopump housing 40 is attached to the motor housing 21. A flange at another end of the cryopump housing 40 is attached to a gate valve (not shown) of the vacuum chamber 102. Any publicly known cryopump may be employed as the cryopump 10.

The cryopump system 100 includes the compressor unit 50 and a working gas circuit 70. The compressor unit 50 is provided to circulate the working gas in the working gas circuit 70. The working gas circuit 70 includes a gas line 72 that connects the cryopump 10 and the compressor unit 50. The gas line 72 is a closed fluid circuit including the cryopump 10 and the compressor unit 50.

The compressor unit 50 includes a compressor 52 and a compressor motor 53. The compressor 52 is configured to compress the working gas and the compressor motor 53 is configured to operate the compressor 52. The compressor unit 50 includes a low pressure gas inlet 54 and a high pressure gas outlet 56. The low pressure gas inlet 54 receives a low pressure working gas and the high pressure gas outlet 56 discharges the high pressure working gas. The low pressure gas inlet 54 is connected through a low pressure channel 58 to a suction port of the compressor 52, and the high pressure gas outlet 56 is connected through a high pressure channel 60 to a discharge port of the compressor 52.

The compressor unit 50 includes a first pressure sensor 62 and a second pressure sensor 64. The first pressure sensor 62 is provided with the low pressure channel 58 for measuring the pressure of the low pressure working gas, and the second pressure sensor 64 is provided with the high pressure channel 60 for measuring the pressure of the high pressure working gas. Here, the first pressure sensor 62 and the second pressure sensor 64 may be disposed at appropriate locations in the working gas circuit 70 outside the compressor unit 50.

The gas line 72 includes a high pressure line 76 and a low pressure line 78. The high pressure line 76 supplies the working gas from the compressor unit 50 to the cryopump 10, and the low pressure line 78 returns the working gas from the cryopump 10 to the compressor unit 50. The high pressure line 76 constitutes the piping connecting the high pressure gas inlet 24 of the cryopump 10 and the high pressure gas outlet 56 of the compressor unit 50. The low pressure line 78 constitutes the piping connecting the low pressure gas outlet 26 of the cryopump 10 and the low pressure gas inlet 54 of the compressor unit 50.

The compressor unit 50 collects the low pressure working gas discharged by the cryopump 10 through the low pressure line 78. The compressor 52 compresses the low pressure working gas to generate the high pressure working gas. The compressor unit 50 supplies the high pressure working gas through the high pressure line 76 to the cryopump 10.

The working gas circuit 70 includes a gas quantity adjustment unit 74 configured to adjust a working gas quantity of the gas line 72. Hereinafter, the quantity of substance (mole) or a mass of the working gas accommodated in the gas line 72 may be called "gas quantity".

The gas quantity adjustment unit 74 includes a buffer volume, for example, includes at least one storage tank 80. The gas quantity adjustment unit 74 includes a channel selector 82 configured to select a channel for connection between the storage tank 80 and the gas line 72. The channel selector 82 includes at least one control valve. The gas quantity adjustment unit 74 includes a tank channel 84 for connecting the storage tank 80 to the channel selector 82.

Further, the gas quantity adjustment unit 74 includes a gas replenishing channel 86 for allowing the working gas to flow from the storage tank 80 to the low pressure line 78, and a gas collecting channel 88 for allowing the working gas to flow from the high pressure line 76 to the storage tank 80. The gas replenishing channel 86 connects the channel selector 82 to a first branch 90 of the low pressure line 78. The gas collecting channel 88 connects the channel selector 82 to a second branch 92 of the high pressure line 76.

The channel selector 82 is configured to be able to select between a replenishing state and a collecting state. In the replenishing state, the gas replenishing channel 86 provides fluid communication between the low pressure line 78 and the storage tank 80 while fluid communication between the high pressure line 76 and the storage tank 80 is blocked. In contrast, in the collecting state, the gas collecting channel 88 provides fluid communication between the high pressure line 76 and the storage tank 80 while fluid communication between the low pressure line 78 and the storage tank 80 is blocked.

The channel selector 82 includes, for example, a three-way valve as illustrated. Three ports of the three-way valve are respectively connected to the tank channel 84, the gas replenishing channel 86, and the gas collecting channel 88. Thus, the channel selector 82 connects the tank channel 84 to the gas replenishing channel 86 to take the replenishing state, and connects the tank channel 84 to the gas collecting channel 88 to take the collecting state.

The gas quantity adjustment unit 74 is provided accompanying the compressor unit 50, and is regarded as a part of the compressor unit 50. The gas quantity adjustment unit 74 may be built in the compressor unit 50. Alternatively, the gas quantity adjustment unit 74 may be separately configured from the compressor unit 50, and disposed in an arbitrary location of the gas line 72.

The cryopump system 100 includes a control device 110 configured to control the operation thereof. The control device 110 is provided as an integral part of, or separately from, the cryopump 10 (or the compressor unit 50). The control device 110 includes, for example, a CPU for performing various arithmetic operations, a ROM for storing various control programs, a RAM for providing a work area to store data and execute programs, an input/output interface, and a memory. A publicly known controller with such a configuration may be used as the control device 110. The control device 110 may be a single controller or include a plurality of controllers each performing an identical or different function.

Figure 2:
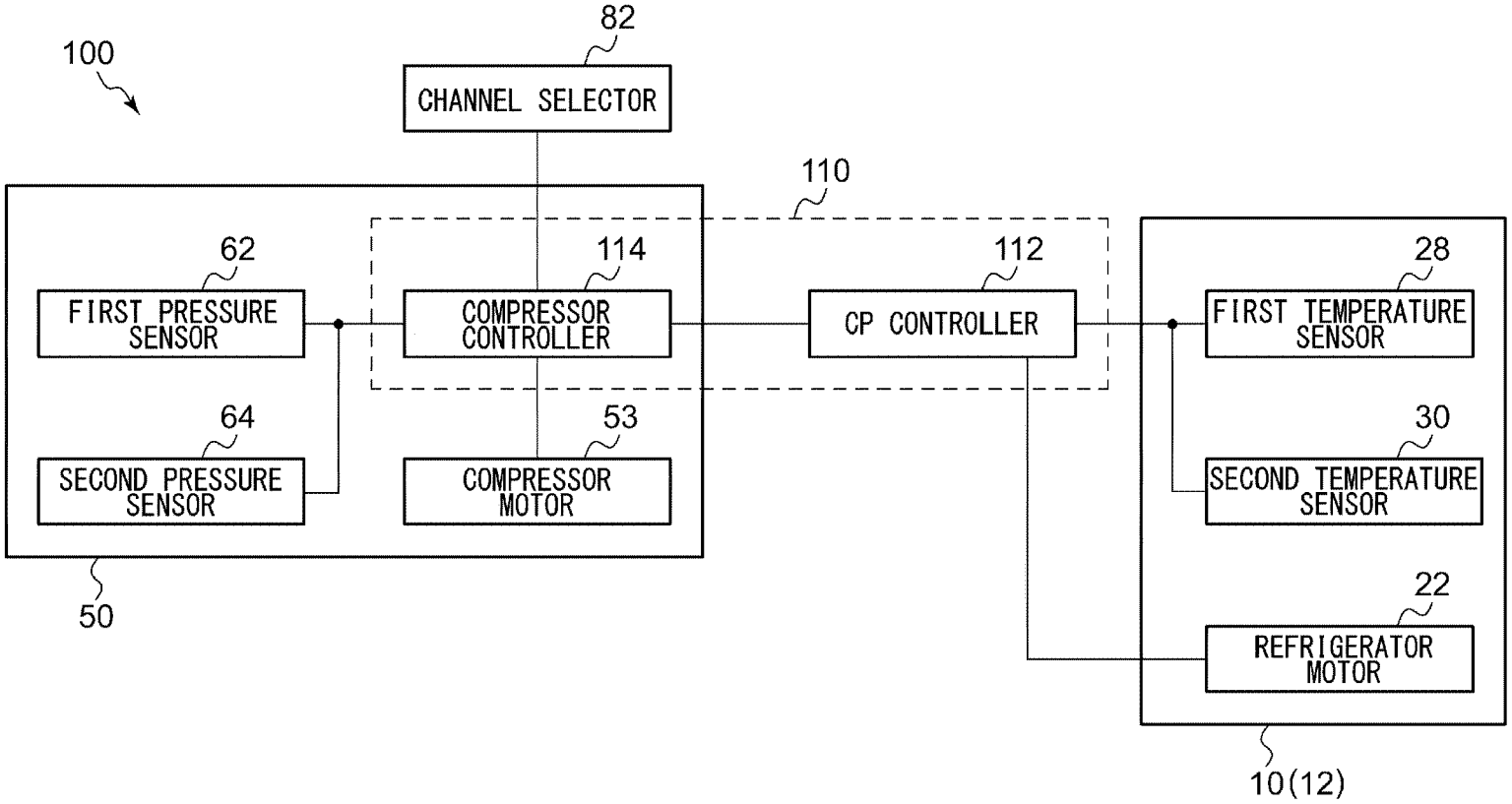
FIG. 2 is a block diagram illustrating an outline of a configuration of a control device for a cryopump system according to an embodiment of the present invention.

FIG. 2 is a block diagram illustrating an outline of a configuration of the control device 110 for the cryopump system 100 according to an embodiment of the present invention. FIG. 2 illustrates principal portions of the cryopump system 100 in connection with an embodiment of the present invention.

The control device 110 is provided to control the cryopump 10 (that is, the refrigerator 12), the compressor unit 50, and the gas quantity adjustment unit 74. The control device 110 includes a cryopump controller (hereinafter also referred to as CP controller) 112 configured to control the operation of the cryopump 10 and a compressor controller 114 configured to control the operation of the compressor unit 50.

The CP controller 112 is configured to receive signals representing temperatures measured by the first temperature sensor 28 and the second temperature sensor 30 of the cryopump 10. The CP controller 112 controls the cryopump 10, for example, based on a measured temperature that has been received. In this case, for example, the CP controller 112 controls an operation frequency of the refrigerator 12 such that the measured temperature of the first (or second) temperature sensor 28 (30) agrees with a target temperature of the first (or second) cryopanel 32 (34). The rotational speed of the refrigerator motor 22 is controlled according to the operation frequency.

The compressor controller 114 is configured to provide a pressure control for the gas line 72. The compressor controller 114 is configured to receive signals representing pressures measured by the first pressure sensor 62 and the second pressure sensor 64 in order to provide the pressure control. The compressor controller 114 controls an operation frequency of the compressor 52 such that a measured value of pressure agrees with a target pressure value. The rotational speed of the compressor motor 53 is controlled according to the operation frequency.

Further, the compressor controller 114 is configured to control the channel selector 82 of the gas quantity adjustment unit 74. The compressor controller 114 selects the replenishing state or the collecting state based on an input including the operation frequency of the compressor 52, for example. The compressor controller 114 controls the channel selector 82 according to the selected state. Details of the control of the compressor unit 50 and the gas quantity adjustment unit 74 will be described below with reference to FIGS. 4 to 6.

Figure 3:
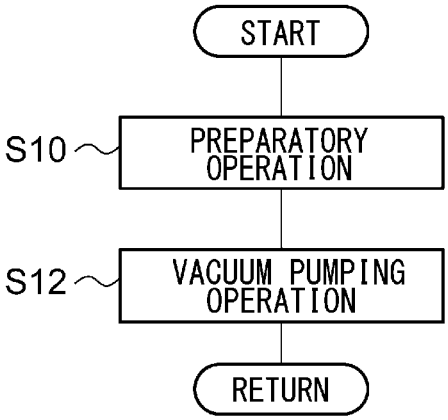
FIG. 3 is a flowchart for describing a method of operating a cryopump system in connection with an embodiment of the present invention.

FIG. 3 is a flowchart for describing a method of operating the cryopump system 100 in connection with an embodiment of the present invention. This method of operation includes a preparatory operation (S10) of the cryopump 10 and a vacuum pumping operation (S12). The vacuum pumping operation is a normal operation of the cryopump 10. The preparatory operation includes any state of operation to be performed before the normal operation. The CP controller 112 executes this method of operation timely and iteratively.

The preparatory operation (S10) is, for example, a startup of the cryopump 10. The startup of the cryopump 10 includes a cooldown for cooling the cryopanels 32 and 34 from an environmental temperature (for example, a room temperature), in which the cryopump 10 is located, to a cryogenic temperature. A target cooling temperature of the cooldown is a standard operating temperature set for the vacuum pumping operation. The standard operating temperature is selected from a range of about 80 K to 100 K for the first cryopanel 32, and from a range of about 10 K to 20 K for the second cryopanel 34 as described above.

The preparatory operation (S10) may be a regeneration of the cryopump 10. The regeneration is performed after the current vacuum pumping operation is completed as a preparation for the next vacuum pumping operation. The regeneration is a so-called full regeneration that regenerates the first and second cryopanels 32 and 34, or a partial regeneration to regenerate the second cryopanel 34.

The regeneration includes a warming process, a discharging process, and a cooling process. The warming process includes warming of the cryopump 10 to a regeneration temperature that is higher than the standard operating temperature. In the case of the full regeneration, the regeneration temperature is, for example, the room temperature or a temperature somewhat higher than the room temperature (for example, about 290 K to about 300 K). A heat source for the warming process is, for example, a reverse temperature elevation of the refrigerator 12 and/or a heater (not shown) attached to the refrigerator 12.

The discharging process includes discharging to the outside of the cryopump 10 gases that have been revaporized from the surfaces of the cryopanels. The revaporized gases, together with a purge gas to be introduced as appropriate, is discharged to the outside of the cryopump 10. In the discharging process, the operation of the refrigerator 12 is stopped. The cooling process includes cooling again the cryopanels 32 and 34 in order to restart the vacuum pumping operation. The cooling process is similar to the cooldown for the startup in terms of the operation of the refrigerator 12.

A time period of the preparatory operation constitutes downtime of the cryopump 10 (in other words, the vacuum pumping operation is suspended for the time period); therefore, it is desirable that this time period be as short as possible. In contrast, the normal vacuum pumping operation is an operation mode for maintaining the standard operating temperature in a stable manner. Hence, the preparatory operation imposes an increased load to the cryopump 10 (i.e. the refrigerator 12) in comparison with the normal operation. For example, the cooldown operation needs a higher refrigerating capacity of the refrigerator 12 than the normal operation. Similarly, the operation of the reverse temperature elevation needs a high temperature elevation capacity of the refrigerator 12. Hence, the refrigerator motor 22 is operated at a considerably high rotational speed (for example, at a speed near the maximum tolerable rotational speed) during the preparatory operation in most cases.

In parallel with the preparatory operation of the cryopump 10, a preparatory operation of the compressor unit 50 may be performed. The preparatory operation of the compressor unit 50 may include a preparatory action for gas quantity adjustment according to an embodiment of the present invention. This preparatory action may include a reset action for restoring the pressure of the storage tank 80 to an initial pressure. This initial pressure is equivalent to a precharge pressure of the working gas into the working gas circuit 70.

For the reset action, the compressor controller 114 releases the storage tank 80 to the gas line 72 when the operation of the compressor unit 50 is stopped, and the high pressure and the low pressure of the gas line 72 are substantially uniformized. The storage tank 80 can be restored to an intermediate pressure between the high pressure and the low pressure of the compressor unit 50. The preparatory action is performed during a time period when the operation of the refrigerator 12 is stopped (for example, during the discharging process of the regeneration).

The vacuum pumping operation (S12) is an operation mode where gas molecules coming from the vacuum chamber 102 toward the cryopump 10 are trapped through condensation or adsorption onto the surfaces of the cryopanels 32 and 34 that have been cooled to cryogenic temperatures. The first cryopanel 32 (for example, the baffle 38) causes gases (for example, water) having vapor pressures that are sufficiently reduced by a cooling temperature thereof to condense thereon. Gases having vapor pressures that are not sufficiently reduced by the cooling temperature of the baffle 38 pass through the baffle 38 and reach the heat shield 36. The second cryopanel 34 causes gases (for example, argon) having vapor pressures sufficiently reduced by a cooling temperature thereof to condense thereon. Gases (for example, hydrogen) having vapor pressures not sufficiently reduced by the cooling temperature of the second cryopanel 34 are adsorbed onto the adsorbent of the second cryopanel 34. The cryopump 10 thus can bring the degree of vacuum of the vacuum chamber 102 to a desired level.

Figure 4:
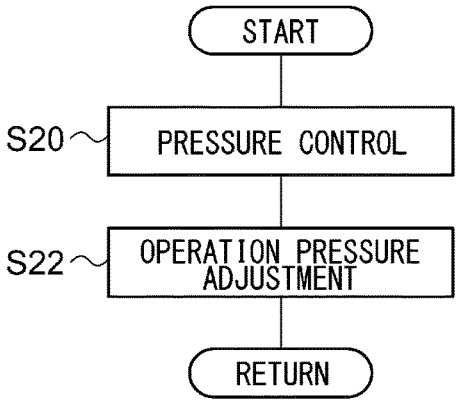
FIG. 4 is a flowchart for describing a method of operating a cryopump system according to an embodiment of the present invention.

FIG. 4 is a flowchart for describing a method of operating the cryopump system 100 according to an embodiment of the present invention. The method illustrated in FIG. 4 relates to the operation of the compressor unit 50. This method of operation includes a pressure control (S20) and an operation pressure adjustment (S22). The compressor controller 114 executes this method of operation timely and iteratively.

The pressure control (S20) is a process of controlling the operation frequency of the compressor 52 under an adjusted working gas quantity such that the measured pressure value agrees with the target pressure value. This pressure control is executed continuously in parallel with the preparatory operation of the cryopump 10 or the vacuum pumping operation.

The target pressure value is, for example, a target value of a differential pressure between the high pressure and the low pressure of the compressor 52. In this case, the compressor controller 114 executes "constant differential pressure control" to control the operation frequency of the compressor 52 such that a differential pressure between the measured pressure of the first pressure sensor 62 and the measured pressure of the second pressure sensor 64 agrees with a target differential pressure value. Here, the target pressure value may be changed while the pressure control is performed.

According to the pressure control, the rotational speed of the compressor motor 53 can be adjusted appropriately depending on a required gas quantity in the refrigerator 12. This contributes to a reduction in the electric power consumption of the cryopump system 100. In addition, according to the constant differential pressure control, the refrigerating capacity of the refrigerator 12 can be maintained at a target capacity because the differential pressure determines the refrigerating capacity of the refrigerator 12. Hence, the constant differential pressure control is particularly advantageous for the cryopump system 100 in that the refrigerating capacity of the refrigerator 12 can be maintained and the electric power consumption by the system can be reduced simultaneously.

Alternatively, the target pressure value may be a target value of the high pressure (or a target value of the low pressure). In this case, the compressor controller 114 performs a constant high pressure control (or a constant low pressure control) in which the rotational speed of the compressor motor 53 is controlled such that the pressure measured by the second pressure sensor 64 (or the first pressure sensor 62) agrees with the target high pressure value (or the target low pressure value).

The operation pressure adjustment (S22) is processing of adjusting an operation pressure of the compressor unit 50. An example of the operation pressure adjustment (S22) will be described with reference to FIGS. 5 and 6.

The operation pressure adjustment is performed to control a discharge flow rate of the compressor unit 50. The discharge flow rate of the compressor unit 50 is depending on, or roughly proportional to, a stroke volume of the compressor 52, the rotational speed of the compressor motor 53, and a suction pressure of the compressor unit 50. The operation pressure adjustment corresponds to changing of the suction pressure of the compressor 52 in these factors having influence on the discharge flow rate.

The operation pressure is adjusted by changing of the working gas quantity of the gas line 72 (that is, the gas quantity circulating between the cryopump 10 and the compressor unit 50). The volume of the gas line 72 is substantially fixed. Therefore, the operation pressure is reduced as the gas quantity of the gas line 72 is decreased. In contrast, the operation pressure is increased as the gas quantity of the gas line 72 is increased.

Figure 5:
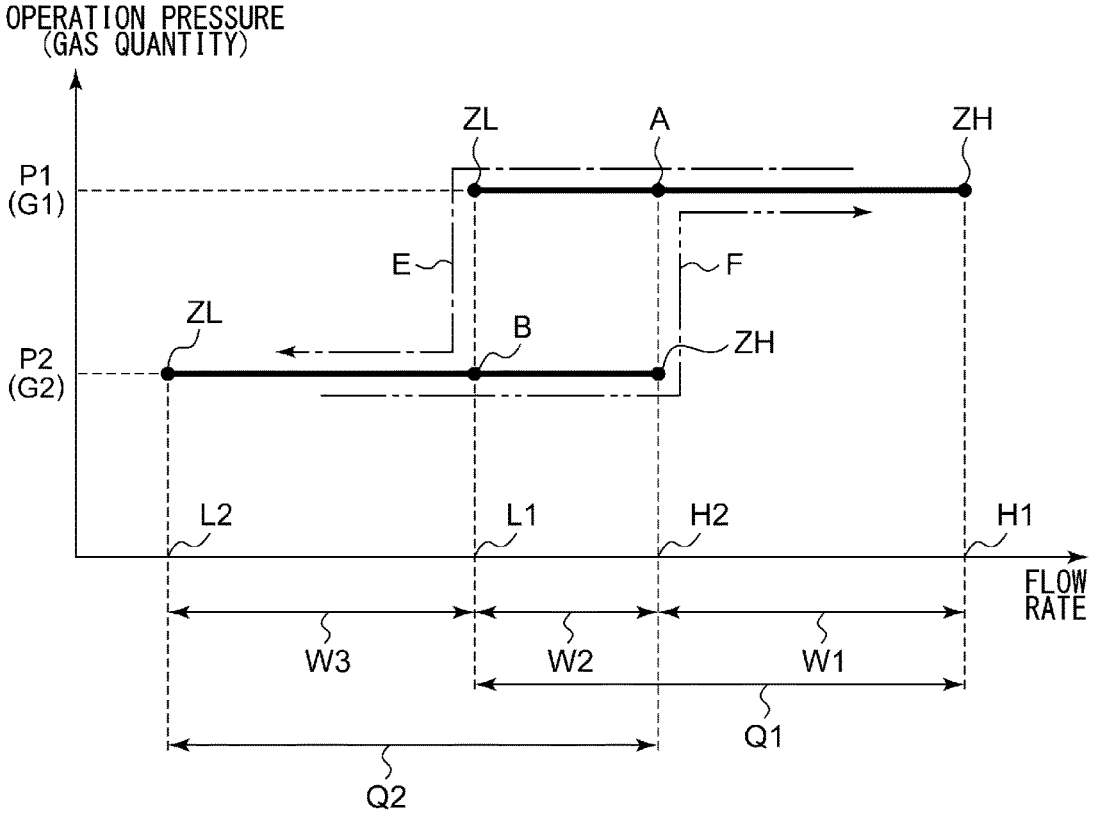
FIG. 5 is a diagram for conceptually describing operation pressure adjustment according to an embodiment of the present invention.

First, the operation pressure adjustment according to the present embodiment will be conceptually described with reference to FIG. 5. The vertical axis of FIG. 5 represents the operation pressure (the suction pressure of the compressor unit 50). Since the gas quantity of the gas line 72 determines the operation pressure, the vertical axis of FIG. 5 can be said to represent the gas quantity. The horizontal axis represents the flow rate (the discharge flow rate of the compressor unit 50).

FIG. 5 representatively illustrates two operation modes, that is, a high pressure mode and a low pressure mode. In an embodiment, the high pressure mode is used in a standard operation state of the cryopump system 100, and the low pressure mode is used in an operation state of a lower load than the standard operation mode.

In the high pressure mode, the working gas quantity of the gas line 72 is adjusted to a first gas quantity G1. The suction pressure of the compressor unit 50 at this time is expressed as a first pressure P1. Further, when the gas line 72 has the first gas quantity G1, the discharge flow rate of the compressor unit 50 takes a first flow rate range Q1. The first flow rate range Q1 is determined according to a controllable range of the operation frequency of the compressor unit 50.

In the low pressure mode, the working gas quantity of the gas line 72 is adjusted to a second gas quantity G2. The suction pressure of the compressor unit 50 at this time is expressed as a second pressure P2. The second gas quantity G2 is smaller than the first gas quantity G1, and thus, the second pressure P2 is smaller than the first pressure P1. Further, when the gas line 72 has the second gas quantity G2, the discharge flow rate of the compressor unit 50 takes a second flow rate range Q2. The second flow rate range Q2 is determined according to the controllable range of the operation frequency of the compressor unit 50.

The controllable range of the operation frequency is predetermined, for example, in specifications of the compressor unit 50. The controllable range corresponds to the rotational speed range that is available in the compressor motor 53, for example. When an upper limit of the controllable range is expressed as ZH, and a lower limit is expressed as ZL, an upper limit of the operation frequency ZH determines an upper limit flow rate H1 of the first flow rate range Q1, and a lower limit of the operation frequency ZL determines a lower limit flow rate L1 of the first flow rate range Q1. Similarly, an upper limit flow rate H2 and a lower limit flow rate L2 of the second flow rate range Q2 are respectively provided by an upper limit of the operation frequency ZH and a lower limit of the operation frequency ZL. The upper limit flow rate H1 of the first flow rate range Q1 is larger than the upper limit flow rate H2 of the second flow rate range Q2, and the lower limit flow rate L1 of the first flow rate range Q1 is larger than the lower limit flow rate L2 of the second flow rate range Q2.

Here, the controllable range means the maximum range that is available in accordance with the specifications. Accordingly, the compressor unit 50 may be controlled in an operation frequency range narrower than the controllable range. In that case, the flow rate range of the high pressure mode is included in the first flow rate range Q1, and is narrower than the first flow rate range Q1. The same applied to the low pressure mode. The control range of the operation frequency in the high pressure mode may differ from the control range of the operation frequency in the low pressure mode.

In the present embodiment, the first flow rate range Q1 and the second flow rate range Q2 partially overlap with each other. Therefore, the first flow rate range Q1 is divided into a first non-overlapping portion W1 where the first flow rate range Q1 does not overlap with the second flow rate range Q2, and an overlapping portion W2 where the first flow rate range Q1 overlaps with the second flow rate range Q2. The first non-overlapping portion W1 is a flow rate range from the flow rate H2 to the flow rate H1, and the overlapping portion W2 is a flow rate range from the flow rate L1 to the flow rate H2. In the first flow rate range Q1, a flow rate equal to the upper limit flow rate H2 of the second flow rate range Q2 is provided by an operation frequency A.

Similarly, the second flow rate range Q2 is divided into the overlapping portion W2 and a second non-overlapping portion W3 where the second flow rate range Q2 does not overlap with the first flow rate range Q1. The second non-overlapping portion W3 is a flow rate range from the flow rate L2 to the flow rate L1. In the second flow rate range Q2, a flow rate equal to the lower limit flow rate L1 of the first flow rate range Q1 is provided by an operation frequency B.

In the present embodiment, the operation mode is switched based on the operation frequency of the compressor unit 50. When a heat load on the refrigerator 12 (see FIG. 1) is decreased or when the cryopump 10 is regenerated, the operation frequency of the refrigerator 12 is decreased, or the operation of the refrigerator 12 is stopped. Since a required gas quantity in the refrigerator 12 becomes smaller, a differential pressure of the gas line 72 is increased. The operation frequency of the compressor unit 50 is in turn decreased in order to recover the differential pressure to a target value. When the operation frequency is decreased in the high pressure mode in this way, the operation mode is switched from the high pressure mode to the low pressure mode, as illustrated by the dashed-line arrow E in FIG. 5. Specifically, with respect to the high pressure mode, the operation mode is switched to the low pressure mode when the operation frequency of the compressor unit 50 is in a region corresponding to the overlapping portion W2 of the controllable range (that is, in a region from the lower limit of the operation frequency ZL to the operation frequency A).

Further, when the heat load to the refrigerator 12 becomes larger, or when a high output operation of the refrigerator 12 is required, the operation frequency of the refrigerator 12 is increased, and the operation frequency of the compressor unit 50 is increased, accordingly. When the operation frequency is increased in the low pressure mode, the operation mode is switched from the low pressure mode to the high pressure mode, as illustrated by the two-dashed line arrow F in FIG. 5. Specifically, with respect to the low pressure mode, the operation mode is switched to the high pressure mode when the operation frequency of the compressor unit 50 is in a region corresponding to the overlapping portion W2 of the controllable range (that is, in a region from the operation frequency B to the upper limit of the operation frequency ZH).

Figure 6:
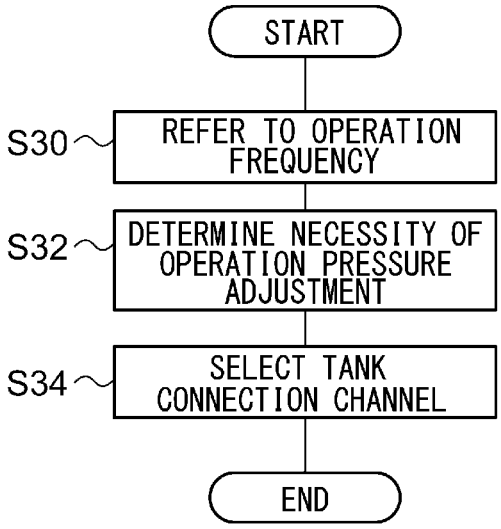
FIG. 6 is a flowchart for describing an operation pressure adjustment process according to an embodiment of the present invention.

FIG. 6 is a flowchart for describing an operation pressure adjustment process according to an embodiment of the present invention. As described above, the compressor controller 114 controls the channel selector 82 based on the operation frequency of the compressor unit 50 for the operation pressure adjustment (S22 of FIG. 4). Accordingly, the working gas quantity of the gas line 72 is adjusted, and the operation pressure of the compressor unit 50 is controlled.

In the processing illustrated in FIG. 6, the compressor controller 114 refers to the operation frequency of the compressor unit 50 (S30). The operation frequency is calculated at each of control periods in the pressure control (S20 of FIG. 4), and the operation frequency currently calculated is stored in the compressor controller 114 or a memory unit accompanying the compressor controller 114 as well as the operation frequencies calculated in the previous periods.

The compressor controller 114 determines necessity of the operation pressure adjustment based on the operation frequency (S32). The compressor controller 114 determines whether the current operation frequency is in a mode transfer region. When the operation frequency is in the mode transfer region, the compressor controller 114 determines that the pressure adjustment is necessary. When the operation frequency is not in the mode transfer region, the compressor controller 114 determines that the pressure adjustment is not necessary. The compressor controller 114 may determine whether the operation frequency stays in the mode transfer region over a predetermined period of time until the present, instead of referring only to the current operation frequency.

The mode transfer region is selected from a frequency region corresponding to the overlapping portion W2 (see FIG. 5) in the control region of the operation frequency. The mode transfer region may be different depending on the operation modes. A transfer region of the high pressure mode (that is, a mode transfer region for determining switching from the high pressure mode to the low pressure mode) is a region including the lower limit of the operation frequency ZL, and may be, for example, the lower limit of the operation frequency ZL. A transfer region of the low pressure mode is a region including the upper limit of the operation frequency ZH, and may be, for example, the upper limit of the operation frequency ZH. As described above, the transfer region of the high pressure mode and the transfer region of the low pressure mode are set not to overlap with each other.

Following the determination of necessity of operation pressure adjustment (S32), the compressor controller 114 executes tank connection channel selection (S34). When it has been determined that the pressure adjustment is necessary, the compressor controller 114 switches the connection channel to the gas line 72 from the storage tank 80. Meanwhile, when it has been determined that the pressure adjustment is not necessary, the compressor controller 114 maintains the connection channel to the gas line 72 from the storage tank 80.

When the operation mode is switched from the high pressure mode to the low pressure mode, the compressor controller 114 cuts off the gas replenishing channel 86, and controls the channel selector 82 to open the gas collecting channel 88 (see FIG. 1). The channel selector 82 thus connects the storage tank 80 to the high pressure line 76. The storage tank 80 acts as a low pressure gas source to the high pressure line 76. The working gas is discharged from the high pressure line 76 to the gas collecting channel 88, and collected in the storage tank 80. The working gas quantity of the gas line 72 is decreased from the first gas quantity G1 to the second gas quantity G2. The operation pressure of the compressor unit 50 is decreased in accordance with the decrease in the gas quantity. Meanwhile, the storage tank 80 is filled with the working gas from the high pressure line 76, and the pressure is increased.

When the operation mode is switched from the low pressure mode to the high pressure mode, the compressor controller 114 cuts off the gas collecting channel 88, and controls the channel selector 82 to open the gas replenishing channel 86. The channel selector 82 thus connects the storage tank 80 to the low pressure line 78. The storage tank 80 acts as a high pressure gas source to the low pressure line 78. The working gas stored in the storage tank 80 is replenished to the low pressure line 78 through the gas replenishing channel 86. The working gas quantity of the gas line 72 is increased from the second gas quantity G2 to the first gas quantity G1. The operation pressure of the compressor unit 50 is increased in accordance with the increase in the gas quantity. The working gas is released from the storage tank 80 to the low pressure line 78, and the pressure of the storage tank 80 is decreased.

In this way, the operation pressure adjustment (S22 of FIG. 4) is over. Hereafter, the pressure control (S20 of FIG. 4) is executed under the adjusted operation pressure. Note that the gas replenishing channel 86 or the gas collecting channel 88 being open for the operation pressure adjustment may be kept open until the next adjustment, or may be closed at an appropriate timing by then.

Note that the compressor controller 114 may determine the necessity of the operation pressure adjustment from a measured pressure of the working gas circuit 70, instead of the operation frequency. When a state in which the operation frequency has reached the upper limit or the lower limit is continued, a measured value used for the pressure control is separated from a target value. Therefore, the compressor controller 114 can appropriately determine the necessity of the operation pressure adjustment similarly even in a case based on the measured pressure of the working gas circuit 70.

As described above, according to the present embodiment, the second flow rate range Q2 has the second non-overlapping portion W3 that does not overlap with the first flow rate range Q1. Therefore, by combination of the first flow rate range Q1 with the second flow rate range Q2, a wider flow rate range than an individual flow rate range can be obtained. By switching of the high pressure mode and the low pressure mode using the gas quantity adjustment unit 74, the discharge flow rate of the compressor unit 50 can be controlled in a wide range from the lower limit flow rate L2 of the second flow rate range Q2 to the upper limit flow rate H1 of the first flow rate range Q1. The extended control range of working gas flow rate can be provided to the cryopump system 100 beyond the limitation due to the specifications of the compressor unit 50.

Alternatively, extending the controllable range of the operation frequency could be considered as a possible way of extending the flow rate control range. However, it may not be practically easy to decrease the lower limit ZL of the controllable range. The compressor unit 50 includes a sliding portion that requires lubrication in the compressor 52 and/or the compressor motor 53. When the compressor unit 50 is operated at a lower speed than the lower limit of the operation frequency ZL, the lubrication may become insufficient. For example, a lubricant film may be less easily formed on the sliding portion. Therefore, it may be difficult to ensure sufficient reliability at the lower speed than the lower limit of the operation frequency ZL. Therefore, the present embodiment has an advantage to ensure a low flow rate range by switching to the low pressure mode without expanding the controllable range of the operation frequency.

According to the present embodiment, the operation modes can be switched in an operation frequency region corresponding to the overlapping portion W2. In the overlapping portion W2, the same flow rate can be realized in both of the operation modes before and after switching. This is useful to smoothly switch the operation modes. For example, when the high pressure mode is switched to the low pressure mode, the same discharge flow rate can be continued by change of the operation frequency of the compressor unit 50 from the lower limit ZL to the value B. Accordingly, switching of the operation modes can be achieved without having large influence on the operation state of the cryopump system 100.

For smooth switching, the gas quantity adjustment unit 74 may include a restriction element such as an orifice. The restriction element is arranged in series on the control valve. For example, the restriction element is provided in each of the gas replenishing channel 86 and the gas collecting channel 88. Thus, the pressure change of when the working gas flows between the gas line 72 and the storage tank 80 can be moderated. That is, the operation pressure of the compressor unit 50 can be changed slowly.

Alternatively, for smooth switching, the compressor controller 114 may limit the change speed of the operation frequency when changing the operation mode. Values of the operation frequencies corresponding to the same flow rate are often substantially different between the high pressure mode and the low pressure mode, and thus the operation frequency may be sharply changed when the operation mode is switched. Therefore, such sharp change can be prevented by temporarily limiting the rate of change of the operation frequency.

Further, according to the present embodiment, the high pressure mode is switched to the low pressure mode by collection of a high pressure gas to the storage tank 80, and the low pressure mode is switched to the high pressure mode by returning of the collected high pressure gas to the gas line 72. Therefore, in the present embodiment, the high pressure gas can be effectively used. In contrast, when a by-pass channel is provided in the compressor, the high pressure gas passing through the by-pass channel is wastefully consumed.

Described above is an explanation based on the exemplary embodiments of the present invention. The invention is not limited to the above-mentioned embodiments, and various design modifications may be added. It will be obvious to those skilled in the art that such modifications are also within the scope of the present invention.

Figure 7:
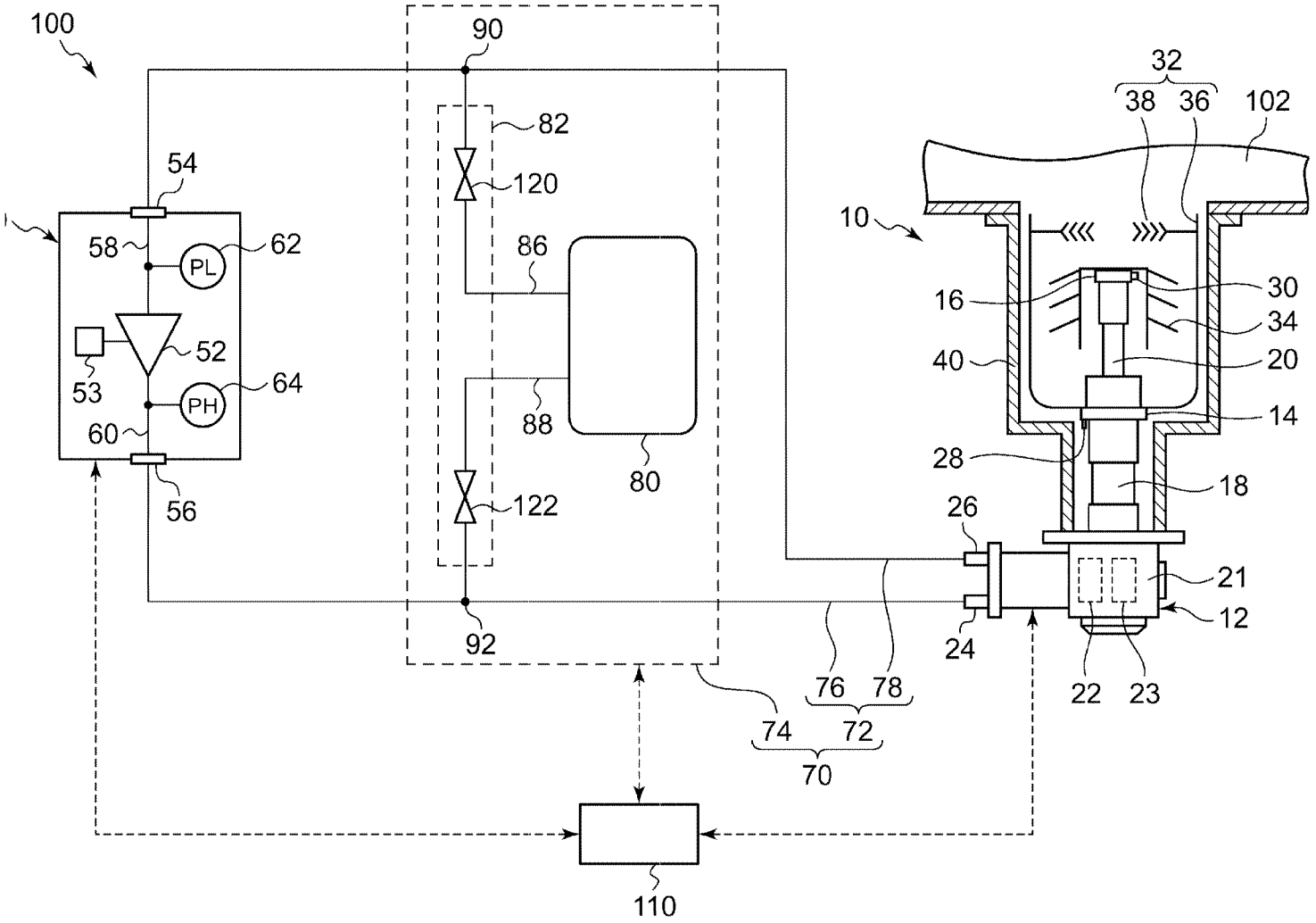
FIG. 7 is a diagram schematically illustrating an overall configuration of a cryopump system according to another embodiment of the present invention.

The gas quantity adjustment unit 74 is not limited to the specific configuration illustrated in FIG. 1. The channel selector 82 may include a plurality of control valves as illustrated in FIG. 7, for example. As illustrated, a channel selector 82 includes a first control valve 120 and a second control valve 122. The first control valve 120 and the second control valve 122 are two-way valves. The first control valve 120 is provided in the middle of the gas replenishing channel 86, and the gas replenishing channel 86 connects the storage tank 80 to the low pressure line 78. The second control valve 122 is provided in the middle of the gas collecting channel 88, and the gas collecting channel 88 connects the storage tank 80 to the high pressure line 76.

Further, the gas quantity adjustment unit 74 may be configured to adjust the working gas quantity of the gas line 72 to any of three or more gas quantities including the first gas quantity G1 and the second gas quantity G2. In this case, when the working gas quantity of the gas line 72 is a given gas quantity of the three or more gas quantities, the controllable range of the operation frequency provides a flow rate range of the working gas corresponding to the given gas quantity. The flow rate range includes a non-overlapping portion with a flow rate range of the working gas corresponding to another one of the three or more gas quantities. The control device 110 controls the gas quantity adjustment unit 74 to adjust the working gas quantity of the gas line 72 to any of the three or more gas quantities.

Figure 8:
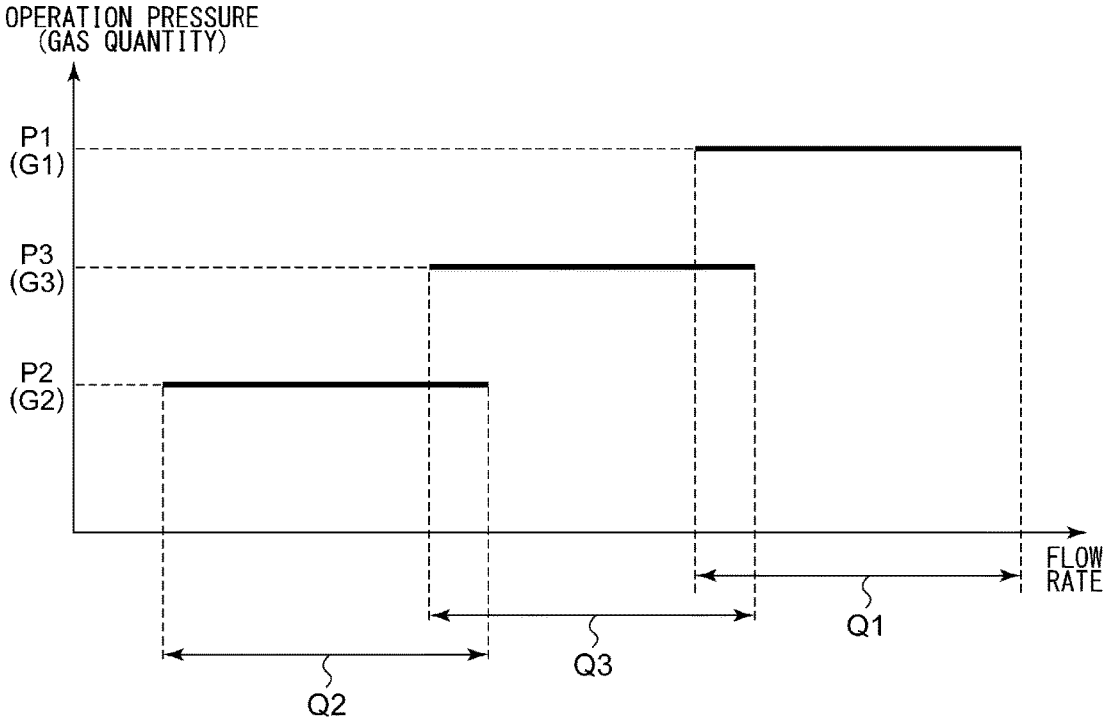
FIG. 8 is a diagram for conceptually describing operation pressure adjustment according to another embodiment of the present invention.

FIG. 8 is a diagram for conceptually describing the operation pressure adjustment according to another embodiment of the present invention. FIG. 8 illustrates three operation modes, that is, the high pressure mode, the intermediate pressure mode, and the low pressure mode. By making a pressure difference between the high pressure mode and the low pressure mode larger and adding the intermediate pressure mode therebetween, the flow rate control range can be further increased.

In the high pressure mode and the low pressure mode illustrated in FIG. 8, the working gas quantity of the gas line 72 is adjusted to the first gas quantity G1 and the second gas quantity G2, respectively. Therefore, the high pressure mode and the low pressure mode respectively provide the first flow rate range Q1 and the second flow rate range Q2. Note that, as illustrated in FIG. 8, the first flow rate range Q1 and the second flow rate range Q2 do not overlap with each other.

In the intermediate pressure mode, the working gas quantity of the gas line 72 is adjusted to the third gas quantity G3. The suction pressure of the compressor unit 50 of this time is expressed as a third pressure P3. The third gas quantity G3 lies midway between the first gas quantity G1 and the second gas quantity G2, and thus the third pressure P3 lies midway between the first pressure P1 and the second pressure P2. When the gas line 72 has the third gas quantity G3, the discharge flow rate of the compressor unit 50 falls in the third flow rate range Q3. The third flow rate range Q3 is determined according to the controllable range of the operation frequency of the compressor unit 50. A large flow rate portion of the third flow rate range Q3 may overlap with the first flow rate range Q1. A small flow rate portion of the third flow rate range Q3 may overlap with the second flow rate range Q2.

Figure 9:
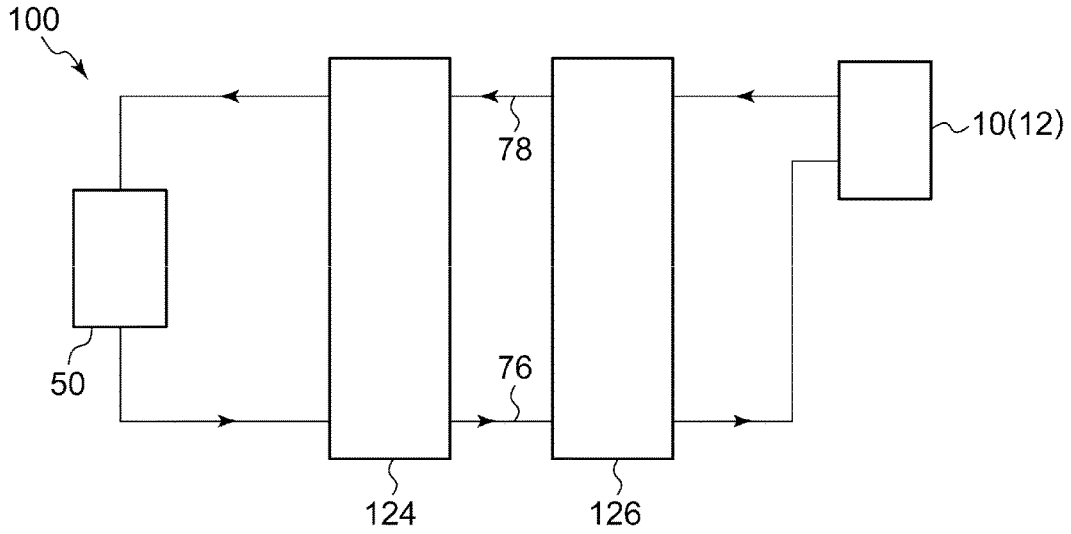
FIG. 9 is a diagram schematically illustrating an overall configuration of a cryopump system according to another embodiment of the present invention.

FIG. 9 exemplarily illustrates the cryopump system 100 configured to be able to switch the three operation modes. In the cryopump system 100, a first gas quantity adjustment unit 124 and a second gas quantity adjustment unit 126 are provided in parallel. The first gas quantity adjustment unit 124 and the second gas quantity adjustment unit 126 may have a similar configuration to the gas quantity adjustment unit 74 illustrated in FIG. 1 or the gas quantity adjustment unit 74 illustrated in FIG. 7.

The first gas quantity adjustment unit 124 is provided to switch the working gas quantity of the gas line 72 to the first gas quantity G1 and the third gas quantity G3. The second gas quantity adjustment unit 126 is provided to switch the working gas quantity of the gas line 72 to the third gas quantity G3 and the second gas quantity G2. Therefore, the high pressure mode and the intermediate pressure mode can be switched by use of the first gas quantity adjustment unit 124, and the intermediate pressure mode and the low pressure mode can be switched by use of the second gas quantity adjustment unit 126. The cryopump system 100 may be configured to be able to switch four or more operation modes by adding of an additional gas quantity adjustment unit in parallel with the first and second gas quantity adjustment units 124 and 126.

In an embodiment, the channel selector 82 of the gas quantity adjustment unit 74 may include a flow rate control valve. Further, the gas quantity adjustment unit 74 may include a tank pressure sensor for measuring a gas pressure of the storage tank 80. The compressor controller 114 may be configured to control the flow rate control valve so as to control the gas pressure of the storage tank 80 based on a measured pressure of the tank pressure sensor. Accordingly, the gas quantity of the gas line 72 can be controlled, and the compressor unit 50 can be operated at a desired operation pressure. That is, the gas quantity adjustment unit 74 can be configured to be able to switch a number of operation modes.

Figure 10:
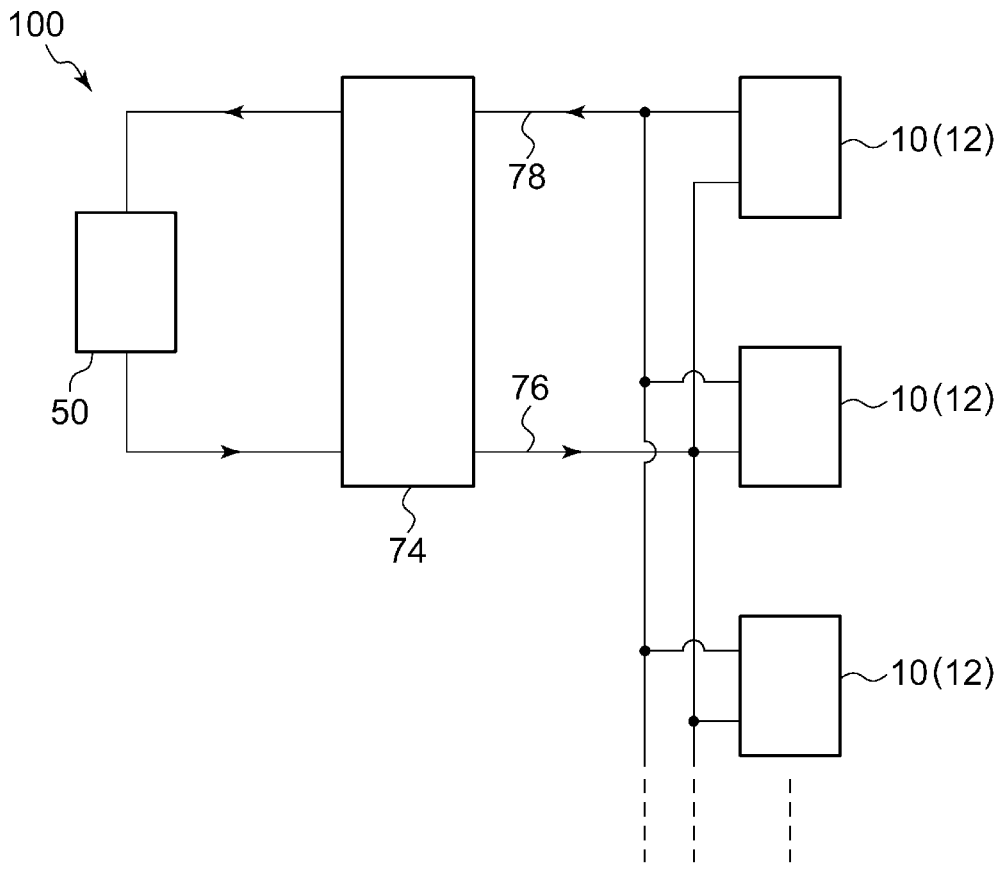
FIG. 10 is a diagram schematically illustrating an overall configuration of a cryopump system according to a further embodiment of the present invention.

In addition, the cryopump system 100 may include a plurality of cryopumps 10 as illustrated in FIG. 10. A plurality of cryopumps 10 is provided in parallel with the compressor unit 50 and the gas quantity adjustment unit 74. As the number of cryopumps 10 is large, the cryopump system 100 requires a wider working gas flow rate range. Hence, the present invention is preferred for the cryopump system 100 including the plurality of cryopumps 10.

In an embodiment, a cryogenic device including a refrigerator 12 instead of a cryopump 10 may be provided. It is apparent for a person skilled in the art that the gas quantity adjustment according to an embodiment of the present invention is applicable to a cryogenic system including such a cryogenic device.

It should be understood that the invention is not limited to the above-described embodiment, but may be modified into various forms on the basis of the spirit of the invention. Additionally, the modifications are included in the scope of the invention.

Priority is claimed to Japanese Patent Application No. 2013-49490, filed on Mar. 12, 2013, the entire content of which is incorporated herein by reference.

What is claimed is:

1. A cryopump system comprising:

a cryopump;

a compressor of a working gas for the cryopump;

a gas line connecting the cryopump and the compressor;

a gas quantity adjuster configured to switch a working gas quantity of the gas line between at least a first gas quantity and a second gas quantity; and a controller configured to control an operation frequency of the compressor and configured to control the gas quantity adjuster based on a current operation frequency of the compressor during an operation of the cryopump, wherein the controller comprises a predetermined compressor operation frequency upper limit and a predetermined compressor operation frequency lower limit, the operation frequency of the compressor being variable in an operation frequency range between the upper limit and the lower limit, the operation frequency range providing a first flow rate range of the working gas when the gas line has the first gas quantity, and providing a second flow rate range of the working gas when the gas line has the second gas quantity, and wherein the second flow rate range has an overlapping portion in flow rate of the working gas and a non-overlapping portion with the first flow rate range, the controller further comprises a first mode transfer operation frequency region and a second mode transfer operation frequency region each corresponding to the overlapping portion and not overlapped in operation frequency of the compressor with each other, the controller is configured to determine whether the current operation frequency of the compressor during the operation of the cryopump is in the first mode transfer operation frequency region or in the second mode transfer operation frequency region and configured to control the gas quantity adjuster such that, if the current operation frequency of the compressor is in the first mode transfer operation frequency region and the gas line has the first gas quantity, then the gas quantity adjuster switches from the first gas quantity to the second gas quantity during the operation of the cryopump, and, if the current operation frequency of the compressor is in the second mode transfer operation frequency region and the gas line has the second gas quantity, then the gas quantity adjuster switches from the second gas quantity to the first gas quantity during the operation of the cryopump.

2. The cryopump system according to claim 1, wherein the gas line comprises a high pressure line for supplying the working gas from the compressor to the cryopump, the gas quantity adjuster comprises a storage tank for collecting the working gas from the high pressure line, and a control valve provided between the storage tank and the high pressure line, and the controller controls the control valve to collect a part of the first gas quantity from the high pressure line to the storage tank to cause the gas line to have the second gas quantity.

3. The cryopump system according to claim 1, wherein the cryopump system comprises a plurality of cryopumps, and the gas line connects the plurality of cryopumps in parallel with the compressor.

4. A method of operating a cryopump system, comprising:

during an operation of a cryopump, controlling an operation frequency of a compressor for the cryopump in an operation frequency range between a predetermined compressor operation frequency upper limit and a predetermined compressor operation frequency lower limit, the operation frequency range providing a first flow rate range when the working gas of the first gas quantity circulates, and providing a second flow rate range when the working gas of the second gas quantity circulates, and wherein the second flow rate range has an overlapping portion in flow rate of the working gas and a non-overlapping portion with the first flow rate range;

determining whether a current operation frequency of the compressor during the operation of the cryopump is in a first mode transfer operation frequency region corresponding to the overlapping portion;

determining whether the current operation frequency of the compressor during the operation of the cryopump is in a second mode transfer operation frequency region corresponding to the overlapping portion and not overlapped in operation frequency of the compressor with the first mode transfer operation frequency region;

during the controlling, adjusting a working gas quantity that circulates between the cryopump and the compressor from a first gas quantity to a second gas quantity if the current operation frequency of the compressor is in the first mode transfer operation frequency region and the working gas of the first gas quantity circulates; and during the controlling, adjusting the working gas quantity that circulates between the cryopump and the compressor from the second gas quantity to the first gas quantity if the current operation frequency of the compressor is in the second mode transfer operation frequency region and the working gas of the second gas quantity circulates.

5. A compressor unit of a working gas for a cryogenic device, the compressor unit comprising:

a compressor;

a gas quantity adjuster configured to switch a working gas quantity that circulates between the compressor and the cryogenic device between at least a first gas quantity and a second gas quantity; and a compressor controller configured to control an operation frequency of the compressor and configured to control the gas quantity adjuster based on a current operation frequency of the compressor during an operation of the cryogenic device, wherein the compressor controller comprises a predetermined compressor operation frequency upper limit and a predetermined compressor operation frequency lower limit, the operation frequency of the compressor being variable in an operation frequency range between the upper limit and the lower limit, the operation frequency range providing a first flow rate range of the working gas when the working gas of the first gas quantity circulates, and providing a second flow rate range of the working gas when the working gas of the second gas quantity circulates, and wherein the second flow rate range has an overlapping portion in flow rate of the working gas and a non-overlapping portion with the first flow rate range, the compressor controller further comprises a first mode transfer operation frequency region and a second mode transfer operation frequency region each corresponding to the overlapping portion and not overlapped in operation frequency of the compressor with each other, the compressor controller is configured to determine whether the current operation frequency of the compressor during the operation of the cryogenic device is in the first mode transfer operation frequency region or in the second mode transfer operation frequency region and configured to control the gas quantity adjuster such that, if the current operation frequency of the compressor is in the first mode transfer operation frequency region and the working gas of the first gas quantity circulates, then the gas quantity adjuster switches from the first gas quantity to the second gas quantity during the operation of the cryogenic device, and, if the current operation frequency of the compressor is in the second mode transfer operation frequency region and the working gas of the second gas quantity circulates, then the gas quantity adjuster switches from the second gas quantity to the first gas quantity during the operation of the cryogenic device.

6. The cryopump system according to claim 1, wherein the first mode transfer operation frequency region includes the predetermined compressor operation frequency lower limit, and/or, wherein the second mode transfer operation frequency region includes the predetermined compressor operation frequency upper limit.

7. The cryopump system according to claim 1, wherein the first mode transfer operation frequency region is the predetermined compressor operation frequency lower limit, and/or, wherein the second mode transfer operation frequency region is the predetermined compressor operation frequency upper limit.

8. The cryopump system according to claim 1, wherein the gas line comprises a low pressure line connecting the cryopump and the compressor to return the working gas from the cryopump to the compressor and a high pressure line connecting the cryopump and the compressor to supply the working gas from the compressor to the cryopump, the gas quantity adjuster comprises at least one storage tank, a gas replenishing channel allowing the working gas flow from the storage tank to the low pressure line and a gas collecting channel allowing the working gas to flow from the high pressure line to the storage tank, the gas replenishing channel comprises a restriction element, and/or, the gas collecting channel comprises a restriction element.

9. The cryopump system according to claim 1, wherein the controller is configured to temporarily limit a rate of change of the operation frequency of the compressor when the gas quantity adjuster switches the working gas quantity of the gas line between the first gas quantity and the second gas quantity.

* * * * *